United States Patent [19]

Ford

[11] 4,227,282

[45] Oct. 14, 1980

[54] SLIDERS AND RAIL FOR DOOR SUPPORT

[75] Inventor: James A. Ford, Sherman Township, St. Joseph County., Mich.

[73] Assignee: Kirsch Company, Sturgis, Mich.

[21] Appl. No.: 908,057

[22] Filed: May 22, 1978

[51] Int. Cl.[2] ..... E05D 13/02

[52] U.S. Cl. ..... 16/93 R

[58] Field of Search ..... 16/87.2, 87.4 R, 87.6, 16/97, 93 D, 93 R, 94 R, 94 D, 95 R, 95 D, 96 D, 87.4; 160/345

[56] References Cited

U.S. PATENT DOCUMENTS

| | | | |
|---|---|---|---|
| 1,377,135 | 5/1921 | Kules | 16/95 |
| 1,463,598 | 7/1923 | Seaman | 160/345 |
| 1,832,203 | 11/1931 | Gussack | 16/97 |
| 2,293,841 | 8/1942 | Long | 16/97 |
| 2,446,887 | 8/1948 | Shearer | 16/97 |
| 2,798,246 | 7/1957 | Holloway | 16/95 |
| 2,863,164 | 12/1958 | Schesvold | 16/87.4 R |
| 2,982,988 | 5/1961 | Blackmer | 16/97 |
| 2,996,115 | 8/1961 | Klenz | 160/345 |
| 3,296,651 | 1/1967 | Baker | 16/87.4 R |
| 3,358,319 | 12/1967 | Hillenbrand et al. | 16/87.4 R |
| 3,434,524 | 3/1969 | Fein | 16/87.4 R |
| 3,460,603 | 8/1969 | Toder | 160/345 |
| 3,503,434 | 3/1970 | Ford | 160/345 |
| 3,522,621 | 8/1970 | Ford et al. | 16/87.4 |
| 3,616,486 | 11/1971 | Ford et al. | 16/87.2 |
| 3,703,740 | 11/1972 | Mann et al. | 16/93 D |
| 3,785,005 | 1/1974 | Baker | 16/87.4 |

FOREIGN PATENT DOCUMENTS

| | | | |
|---|---|---|---|
| 864652 | 4/1961 | United Kingdom | 16/95 R |

*Primary Examiner*—George H. Krizmanich

*Attorney, Agent, or Firm*—Blanchard, Flynn, Thiel, Boutell & Tanis

[57] ABSTRACT

Suspension system for a drapery, particularly a drapery comprising vertically aligned wooden slats. There is provided a traverse rod suspension system for a drapery comprising a plurality of vertically arranged wooden, or other substantially rigid, slats, same being pivotally related to each other along adjacent vertical edges. The system provides a traverse rod preferably slotted along its bottom with a series of composite hangers, provided therein, such hangers being connected by a flexible member, as a cord. Said composite hangers each has an upper portion arranged in sliding, nonrotatable, relationship with said rod and a bottom section which may be fixed appropriately to the drapery and is pivotally and releasably connectible to said first section. In the preferred embodiment, the first section has a side opening slot with a slightly constricted entry and the lower section has a headed hanger receivable snappably into said slot. Said hanger then has means appropriately engageable with the upper edge of said drapery as well as further means appropriately engageable with the respective leading and trailing (normally stationary) vertical edges of said drapery.

1 Claim, 6 Drawing Figures

SLIDERS AND RAIL FOR DOOR SUPPORT

FIELD OF THE INVENTION

The invention relates to traverse rod systems and particularly to a type of traverse rod system primarily adapted to the support of draperies comprising a plurality of vertically arranged, relatively rigid (as wooden) slats which are pivotally connected along their respectively adjacent vertical edges. The traverse rod system of the invention provides a plurality of composite hangers interconnected by a flexible member, as a cord. Each hanger has an upper section permanently but slidably held within said traverse rod and a lower section permanently affixed appropriately to the drapery, said upper and lower sections being snappably and swivelly connectible together.

BACKGROUND OF THE INVENTION

In providing means for mounting drapery panels onto the sliders of a traverse rod, there has long been recognized the problem of enabling said panels to be quickly applied to said traverse rod and equally quickly removable therefrom. This is desirable for washing or otherwise cleaning the drapery material and/or for applying, removing or changing the drapery material according to the season. Thus, for example, in a given southerly or southwesterly facing room with a large picture window, it may be desirable to have a sun-shading type of drapery, such as a drapery comprising vertically arranged wooden slats during the winter when the sun is low and would otherwise shine into the room but equally desirable to provide a wholly different type of drapery, as one made of a lighter cloth-like material, during the summer when the sun is higher. Alternatively, in other circumstances, it may be desirable to have the sun-shading type of drapery during the summer to provide shade against a late afternoon sun when the heat therefrom is undesirable but to provide a relatively light drapery for use in winter when the entry of the sun's rays is desired.

While this subject has been addressed in the past, and a number of designs have been suggested for this purpose, none of them provide fully the ease of operation desired particularly in connection with relatively stiff draperies such as those comprising vertically arranged slats, such as wooden slats, and with minimal spacing between the upper end of the drapery and the traverse rod means.

Particularly, note may be taken of the patent to Ford, U.S. Pat. No. 3,348,603, as showing quick attachable and detachable means but this does not permit swiveling of at least the lower part of a hanger as is desirable in connection with draperies which are expected to fold or pleat as same are moved to open position. It is, of course, recognized that many designs of hangers permit such pivoting of the hangers for this purpose but the pivoting of the entire hanger is not possible when the hangers are connected together by string or other elongated flexible element such as shown in the U.S. Pats. Nos. to Ford, 3,522,621 and 3,616,486.

On the other hand, the patent to Ford, U.S. Pat. No. 3,522,621, while permitting swiveling of at least the lower end of the hanger, does not permit removal of the drapery from the traverse rod excepting by removal of the entire hanger from such rod. While the patent to Ford, U.S. Pat. No. 3,616,486 does permit a snapped attachment of the hanger from the sliding portion thereof within the traverse rod, it is not adaptable to a bottom slotted rod.

U.S. Pat. Nos. 3,296,651 and 3,818,543 (Baker) provide a nonswiveling slider with a swiveling and attachable and detachable lower part but they require vertical motion in the connecting and disconnecting of the lower part of the hanger from the slider portion thereof and hence require an undesirable amount of space between the upper end of the drapery and the lower end of the slider. The present invention substantially diminishes this space. The same is true of German Pat. No. 1,151,102.

Accordingly, the objects of the invention include:

1. To provide a hanger structure particularly adaptable to draperies of the type comprising vertically arranged wooden slats adapted for use in a bottom-slotted traverse rod and permitting quick and easy attaching and detaching of such draperies to and from the slide means of such hangers.

2. To provide hangers, as aforesaid, which will be sufficiently small as to minimize their visibility when in a position of use.

3. To provide hangers, as aforesaid, which will space the upper end of the drapery a minimum distance from the traverse rod.

4. To provide hangers, as aforesaid, which are capable of rapid and inexpensive manufacture, such as by injection molding from a self-lubricating type of plastics materials such as a nylon.

5. To provide hangers, as aforesaid, wherein the manner of such attaching and detaching will be sufficiently obvious as to be apparent to the user without special instructions.

Other objects and purposes of the invention will be apparent to persons acquainted with devices of this general type upon reading the following specification and inspection of the accompanying drawings.

SUMMARY OF THE INVENTION

Figure 1:
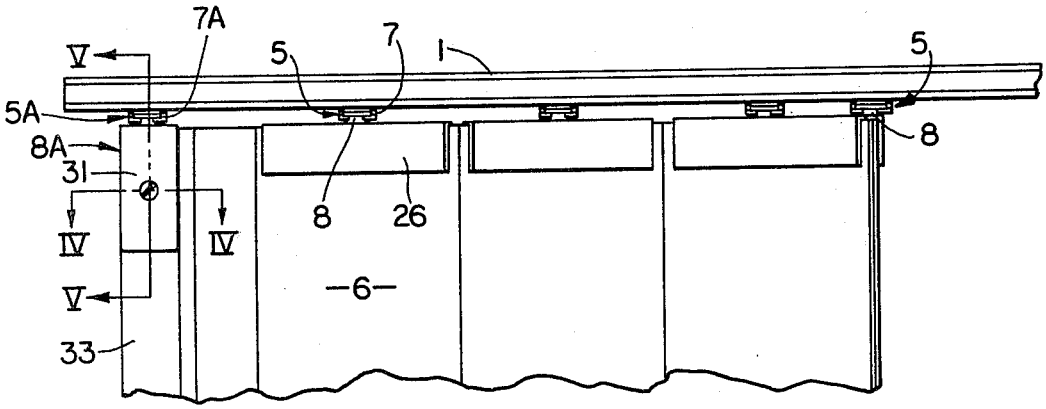
FIG. 1 is a fragmentary front elevational view of a traverse rod, hangers and drapery associated therewith.
Figure 4:
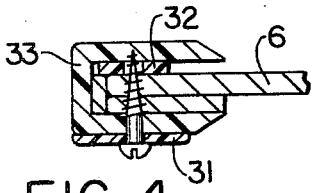
FIG. 4 is a section taken on line IV—IV of FIG. 1.

The above outlined objectives of the invention are obtained by providing a plurality of hangers having head portions which are slidably but nonrotatably receivable onto flanges defining the slot of a bottom-slotted traverse rod. Means are provided for limiting the maximum spacing between such sliders, said means being typically a cord molded into said sliders in the manner set forth and claimed, for example, in U.S. Pat. No. 3,522,621 to Ford. The drapery engaging portion of the hanger is arranged for engaging the drapery in any convenient manner as by riveting, sewing, snap buttons or similar. Means are provided for inter-relating the head and bottom portion of such hanger for swiveling therebetween and for rapid attachment and detachment, namely by providing a head on the bottom portion snappably receivable into a sidewardly opening slot in a part of the head portion depending below the traverse rod.

DETAILED DESCRIPTION

Turning now to the drawings in more detail, there is provided a bottom slotted traverse rod 1 of conventional shape having spaced bottom flanges 2 and 3 defining a bottom slot 4. Depending from said traverse rod by means of hereinafter described hangers is a drapery 6 which may be of any desired material but is here shown as comprising a plurality of vertically arranged wooden slats, such a drapery being that for which the hangers of the present invention were primarily designed.

Turning now to said hanger, same comprises upper and lower hanger parts referred to as a head member 7 and a bottom member 8 respectively. Said head member is of rectangular cross section to ensure that same will not rotate within the traverse rod 1 and is provided with sidewardly direction slots 9 and 11 for engaging the flanges 2 and 3. The several heads 7 in a given traverse rod are connected by a flexible means such as a molded-in cord 12 in a manner already set forth in previous patents such as U.S. Pat. Nos. 3,522,621, 3,616,486 and 3,434,524.

In the lower part of said head 7, namely the portion 13 thereof extending below the bottom surface of the traverse rod 1, there is provided a sidewardly opening slot 14 for purposes appearing herinafter. There is also provided immediately below said slot 14 a further portion 16 and means defining therein a further sidewardly opening slot 17. Said slots 14 and 17 are so related to each other that their central symmetrical axes are parallel with each other but the slot 17 is sufficiently narrower than the slot 14 as to provide and define ledges 18 and 19 on the lower side of the slot 14.

Figure 6:
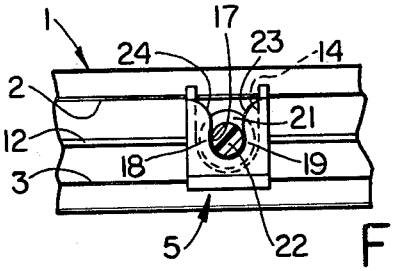
FIG. 6 is a section taken on the line VI—VI of FIG. 2.

The lower portion 8 of the hanger comprises a cylindrical head 21 of a diameter enabling it to be loosely and swivelably received into the slot 14. A cylindrical neck 22 depends from said head 21 and is of smaller diameter so as to be swivelably received into the slot 17. However, as best seen in FIG. 6, the mouth of slot 17 is narrowed sufficiently by the protuberances 23 and 24 that the neck 22 will enter fully into the slot 17 only by snapping past said protuberances. Thus, when said neck 22 has fully entered into the slot 17, the protuberances 23 and 24 will tend to hold it therein until a positive force is applied for snapping said neck against said protuberances in order to accomplish the removal of the lower part 8 of said hanger from the head 7 thereof.

Depending from the neck 22 is any desired structure by which the drapery may conveniently be supported, such as, for example, structure generally similar to that shown in the patent to Stankewich U.S. Pat. No. 2,806,525. In the present embodiment, there is shown as elongated structure 26 of inverted U-shaped which may be conveniently molded integrally with the neck 22 and which will embrace the upper edge of the drapery 6. The drapery may then be fastened to the respective depending flanges 27 and 28 of said attachment 26 as desired, such as by rivets, by sewing, by snap buttons or other convenient means.

Figure 2:
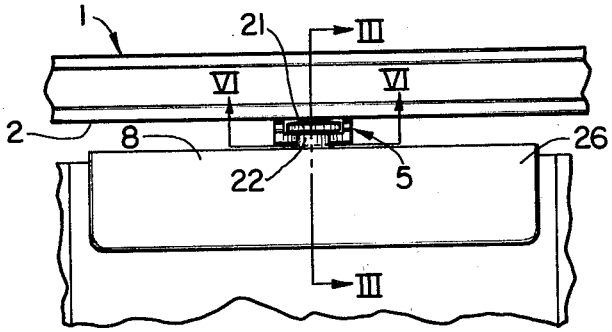
FIG. 2 is a fragmentary view of a portion of FIG. 1 drawn on an enlarged scale.
Figure 5:
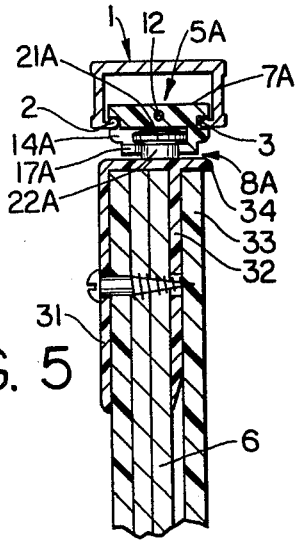
FIG. 5 is a section taken on the line V—V of FIG. 1.
Figure 3:
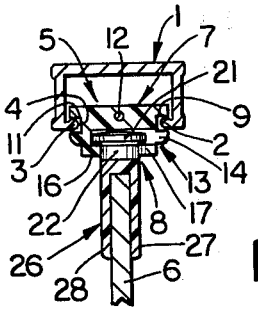
FIG. 3 is a section taken on the line III—III of FIG. 2.

In the case of the hangers of the invention being used with a drapery comprising vertically arranged wooden slats, the attachment device 26 may if desired be relatively elongated as best shown in FIG. 2 in order to effect an accordian-like folding of the drapery while the traveling edge of the drapery will be held by a relatively narrow pair of similarly arranged flanges 31 and 32. Where it is desired for structural reasons to position one of said flanges between the reinforcing edge strip 33 and the drapery 6, the flange 32 may be offset somewhat from the edge 34 of the lower part 8A of the end hanger 5A.

It will be recognized, of course, that in the broader concept of the invention any desired drapery supporting means may be attached to the depending neck 22 and that the use herein of an inverted U-shaped attachment member is for illustrative purposes and is not limiting.

In use, it will be recognized that the head members 7 of both the hangers 5 and the single end hanger 5A may be inserted into the traverse rod when same is installed into place but without, if desired, the lower parts 8 and 8A of said hangers affixed thereto. Said lower parts are then fastened to the drapery in any manner convenient and such convenience is enhanced by the absence of the head portions 7 and 7A therefrom. When the fastening of said lower portions 8 and 8A is completed, the hangers may then be assembled in a rapid and simple manner simply by sliding and snapping the respective heads 21 and 21A into the slots 14 and 14A and the drapery is ready for use.

Removal of the drapery is accomplished merely by sliding and snapping the lower portions out from the slots 14 and 14A by manual pressure suitably applied thereto.

Inasmuch as the slots 14 and 17 as well as their coounterparts in the hanger 5A open sidewardly with respect to the direction of thrust as the drapery is moved in one direction or another along the traverse rod, there will be little or no tendency for the hangers to separate during ordinary use of the traverse rod and the resistance provided by the protuberances 23 and 24 to the escape of the lower parts of said hangers will be sufficient for all normal operating purposes. However, said resistance may still be made of sufficiently low magnitude that such lower portion may be readily detached when it is desired to remove the draperies for any purpose.

In view of the foregoing, it will be recognized that if it is desired to provide different draperies at a given window for use, for example, at different times of the year, it will be a simple matter to fix onto said draperies appropriate lower portions of said hangers in whatever permanent or semipermanent manner is desired and then merely snap into place as above described the lower portions of hangers fixed to any given desired drapery. Since this may be done without removing the head portions of the sliders from the traverse rod, it may be done quickly and easily and the inconvenience associated with removing and reinserting sliders from and into a traverse rod, together with the gate structure required for same is eliminated.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a traverse rod system for supporting a drapery, the combination comprising:

an elongated traverse rod having a downwardly opening slot formed therein and extending longitudinally thereof, said rod having a pair of opposed and inwardly directed flanges defining the opposite sides of said slot;

a drapery hanger slidably supported on said rod for slidable displacement along said slot, said drapery hanger including an upper part which is slidably but nonrotatably supported on said rod within said slot and a lower part which is supported on said upper part for swivelling movement relative thereto about a substantially vertical axis, said lower part depending downwardly from said upper part;

said upper part comprising a substantially rectangular blocklike head member positioned slidably but nonrotatably within said slot and on said flanges, said head member having guide means formed on opposite sides thereof for receiving therein said flanges;

a portion of said head member extending below said traverse rod and including sidewardly opening slot means formed therein, said slot means extending at substantially a right angle relative to the direction of movement of said head member along said traverse rod;

said slot means including a first sidewardly opening slot disposed directly below said traverse rod and being spaced upwardly from the lower surface of said head member, said first slot being of a predetermined height and opening outwardly through one side of the head member with the other end of said first slot being closed by a wall defining the opposite side of said head member;

said slot means including a second sidewardly opening slot positioned below, facing in the same direction as, and in axial alignment with said first sidewardly opening slot, said second slot extending between said first slot and the bottom surface of said head member, said second slot also opening outwardly through the same side of said head member as said first slot, the other end of said second slot being closed;

said second slot being narrower than said first slot for providing an upwardly facing support ledge on both sides thereof;

said lower part including an upper substantially cylindrical head fixedly attached to and coaxially aligned with a cylindrical neck which projects downwardly from said head, said head having a height substantially the same as said predetermined height and a diameter greater than the width of said second slot so that said head when being moved into or removed from said slot means is solely sidewardly slidable and is swivelably supported within the closed end of said first slot due to said head being supported on said ledges, said head when supported within the closed end of said first slot being prevented from upward displacement by a wall on said head member defining the top of said first slot, said cylindrical neck being sidewardly slidably inserted into said second slot and being swivelably supported within the closed end of said second slot, said cylindrical neck projecting downwardly from said second slot beyond the lower surface of said head member;

said second slot adjacent the open end thereof being of a reduced width for creating a snap fit between said head member and said lower part when said cylindrical head and neck are sidewardly slidably inserted into or removed from said slot means, the width of said second slot adjacent the open end thereof being reduced to a spacing which is smaller than the diameter of said cylindrical neck for tending to hold said lower part within said slot means during normal operation of said traverse rod system; and means fixedly attached to the lower end of said neck for engaging and supporting said drapery.

* * * * *

UNITED STATES PATENT OFFICE

CERTIFICATE OF CORRECTION

Patent No. 4 227 282 Dated October 14, 1980

Inventor(s) James A. Ford

It is certified that error appears in the above-identified patent and that said Letters Patent are hereby corrected as shown below:

Column 2, line 48; change "on line" to ---on the line---

Column 3, line 21; "direction" should be ---directed---.

line 56; change "as" to ---an---.

line 57; change "U-shaped" to ---U-shape---.

Column 4, lines 31-32; "coounterparts" should read ---counterparts---.

Signed and Sealed this

*Thirty-first* Day of *March 1981*

[SEAL]

*Attest:*

RENE D. TEGTMEYER

*Attesting Officer*

*Acting Commissioner of Patents and Trademarks*